United States Patent [19]

Neumann et al.

[11] 3,934,640

[45] Jan. 27, 1976

[54] SUBMERGED NOZZLE FOR CONTINUOUS CASTING

[75] Inventors: Friedhelm Neumann, Adliswil; Josef K. Zeller, Weesen, both of Switzerland

[73] Assignee: Concast AG, Zurich, Switzerland

[22] Filed: Dec. 11, 1973

[21] Appl. No.: 423,757

Related U.S. Application Data

[62] Division of Ser. No. 72,692, Sept. 16, 1970, Pat. No. 3,800,853.

[30] Foreign Application Priority Data

Sept. 16, 1969 Switzerland ..... 13937/69

[52] U.S. Cl. ..... 164/281; 222/568 X

[51] Int. Cl.[2] ..... B22D 11/10

[58] Field of Search ..... 164/281, 82; 222/568; 122/DIG. 1

[56] References Cited

UNITED STATES PATENTS

| | | | |
|---|---|---|---|
| 3,310,850 | 3/1967 | Armbruster | 164/281 X |
| 3,395,831 | 8/1968 | Minteer | 222/568 X |
| 3,517,726 | 6/1970 | Mills et al. | 164/281 X |

FOREIGN PATENTS OR APPLICATIONS

| | | | |
|---|---|---|---|
| 898,668 | 12/1953 | Germany | 164/281 |
| 1,158,403 | 7/1969 | United Kingdom | 164/281 |

*Primary Examiner*—Robert D. Baldwin
*Attorney, Agent, or Firm*—Nichol M. Sandoe

[57] ABSTRACT

A nozzle for the continuous casting of steel which has at least one lateral outlet below the slag-covered surface of the molten metal in the mold, is protected against corrosive effects of the slag at the surface of the molten metal and also against erosion in the outlet region of the nozzle by a threaded refractory ring.

1 Claim, 2 Drawing Figures

SUBMERGED NOZZLE FOR CONTINUOUS CASTING

Figure 1:
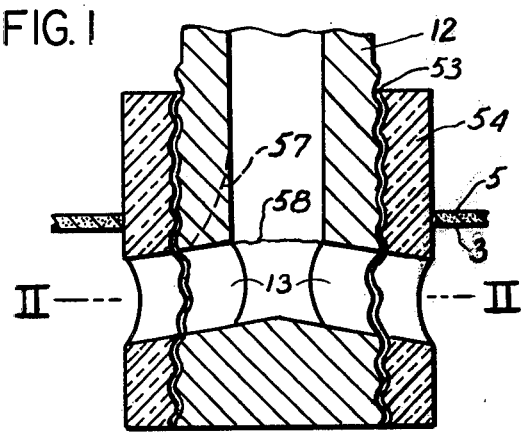

This is a division of co-pending application Ser. No. 72,692 filed Sept. 16, 1970, now U.S. Pat. No. 3,800,853 issued Apr. 2, 1974.

The present invention relates to the continuous casting of steel through a nozzle having at least one submerged outlet through which molten metal is discharged continuously below the slag-covered surface of the molten metal in the mold.

Nozzles with submerged outlets are used in continuous casting plants to prevent oxidation of the steel on its way from the tundish to the mold or from the ladle to the tundish. The use of such nozzles also prevents slag particles and oxides from being washed into the liquid core of the strand.

The increasing weight of individual heats and the introduction of uninterrupted continuous casting have led to a very considerable lengthening of the casting times. This exposes the nozzles of refractory material to considerable wear and the life of these nozzles is a factor that limits the length of the casting times.

If a flux powder is used for covering the surface of the molten metal in the mold, the exterior of the nozzle will show signs of erosion at the level of the surface of the molten metal after relatively short casting times. This is primarily due to the corrosive effect of the slag formed by the powdered flux which is continuously agitated by the movement of the steel in the mold. However, erosion phenomena may appear in the interior of the nozzle in the region of the outlet orifice, particularly when casting manganese alloyed steels. Such erosion phenomena often result in the nozzle breaking off where it has thus been weakened. Such fractures lead to slag being undesirably washed into the liquid core of the strand if the tunish carrying the nozzle is not immediately lowered to re-immerse the end of the nozzle below the metal level. Moreover, in the case of nozzles provided with lateral outlets an adverse pattern of flow in the liquid core of the strand involving the deeper strata, occurs when the portion of the nozzle that dips into the molten metal breaks away. Particularly in curved mold casting plants, changes in the pattern of flow result in erosion of the frozen shell of the casting, increasing the risk of breakout as well as the tendency for cracks to be formed in the casting.

The object of the present invention is to reduce the exterior erosion of the nozzles caused by chemical and physical action of the slag at the surface of the molten metal and to compensate for erosion in the interior of the nozzles in the region of the nozzle outlet to prolong the life of such submerged nozzles.

According to the present invention, this is achieved by concentrically locating a separate ring of refractory material around the nozzle. This ring extends downwards below the surface of the molten metal and upwards above the surface of the layer of slag.

When used with a nozzle having lateral outlets, the ring surrounds the outlet openings of the nozzle extending vertically downward from above the openings, to provide support for the wall of the nozzle and to compensate for the effects of erosion in the outlet area. The ring, which may be threaded or otherwise secured to the nozzle, has openings which register with the nozzle outlet openings.

Embodiments of the present invention will be described in greater detail with reference to the accompanying drawings in which FIG. 1 is a section of the lower end of nozzle.

Figure 2:
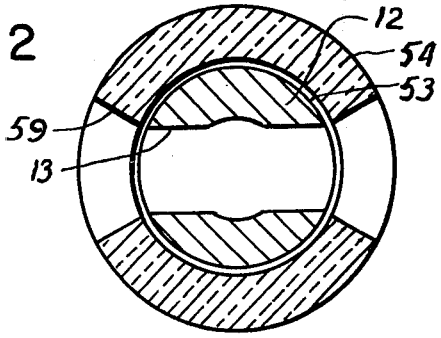

FIG. 2 is a section taken on the line II—II of FIG. 1.

FIG. 1 shows a nozzle 12 which has threads 53 and two lateral outlets 13. The ring 54 is threaded to the nozzle 12 and may be adjusted to a predetermined position in respect to the desired mold metal level 3. The nozzle 2 may also have only one lateral outlet opening 13. The ring 54 protects the exterior of the nozzle from the erosion by the slag 5 and also compensates for the interior erosion indicated by dashed lines 57 in the outlet region of the nozzle 2, which is particularly pronounced during longer casting times when casting manganese alloyed steels. Should the nozzle 12 fracture because of major erosion, for example along an assumed line 58, then the broken part of the nozzle 12 is held in its former location by the threaded ring 54 which also counteracts the dynamic flow forces which act in the direction of the nozzle axis. Casting can therefore continue without any change in the flow conditions.

If desired, the ring 54 may be shaped like a cup, having a horizontal bottom part to provide additional protection against a vertical metal break-through at the bottom of the nozzle 12.

FIG. 2 shows a horizontal cross section of the nozzle 12 and of the ring 54 taken on the line II—II in FIG. 1. The outlet openings 59 in the ring 54 match the outlet openings 13 of the nozzle 12. As an alternative to threads, other means of attachment, such as a bayonet joint, may be used to keep the ring in the desired location against forces acting in the longitudinal axis of the nozzle.

The rings 54 are preferably made of a refractory material which is chemically neutral to the slag. Mixtures of graphite and clay, as are conventionally used for manufacturing nozzles, are quite suitable. Other refractory materials may also be used, but they should be selected with due regard to the composition of the slag and the quality of the steel to be cast. It has been found that the above described rings are exposed to much lower mechanical stresses than the nozzles and can therefore be manufactured of refractory materials with a lower mechanical strength.

The above described nozzles and rings may also be used between the ladle and the tundish.

We claim as our invention:

1. Apparatus for the continuous casting of steel, comprising a casting mold, a tubular nozzle extending into said mold with its lower end adapted to be submerged in the molten metal in the mold, and a refractory ring surrounding said nozzle and concentric therewith, said ring adapted to extend downwardly below the surface of the molten metal and upwardly above the surface of the molten metal, said tubular nozzle being provided with at least one lateral discharge outlet below the surface of the molten metal and said ring being provided with at least one lateral discharge outlet, said ring being rotatable on said nozzle to bring said lateral discharge outlet into register with said lateral discharge outlet of said nozzle, said ring being in threaded engagement with said nozzle from a level above said discharge outlets to a level below said discharge outlets whereby, in the event of fracture of said nozzle within the area of such threaded engagement, the fractured parts of said nozzle are held together by said ring.

* * * * *